US005672936A

United States Patent [19]

Hatsutori et al.

[11] Patent Number: 5,672,936

[45] Date of Patent: Sep. 30, 1997

[54] COLD CATHODE FLUORESCENT DISCHARGE TUBE

[75] Inventors: Masao Hatsutori, Daito; Masaharu Nishida, Kadoma, both of Japan

[73] Assignee: West Electric Co., Ltd., Osaka, Japan

[21] Appl. No.: 266,113

[22] Filed: Jun. 27, 1994

Related U.S. Application Data

[63] Continuation of Ser. No. 881,794, May 12, 1992, abandoned.

[30] Foreign Application Priority Data

May 16, 1991 [JP] Japan ..... 3-111615

[51] Int. Cl.[6] ..... K01J 01/38

[52] U.S. Cl. ..... 313/491; 313/352; 313/550

[58] Field of Search ..... 313/491, 550, 313/556, 558, 562, 352, 231.61, 305

[56] References Cited

U.S. PATENT DOCUMENTS

| | | | |
|---|---|---|---|
| 3,758,809 | 9/1973 | Menelly et al. | 313/491 |
| 3,798,492 | 3/1974 | Menelly | 313/491 |
| 4,303,846 | 12/1981 | Kimura et al. | 313/558 |
| 5,138,224 | 8/1992 | Goldburt et al. | 313/491 |

FOREIGN PATENT DOCUMENTS

| | | | |
|---|---|---|---|
| 495659 | 2/1974 | Japan . | |
| 50106468 | 8/1975 | Japan . | |
| 52-069551 | 6/1977 | Japan | 313/556 |
| 59-121750 | 7/1984 | Japan | 313/491 |
| 6191849 | 5/1986 | Japan . | |

*Primary Examiner*—Sandra L. O'Shea
*Assistant Examiner*—Matthew J. Esserman

[57] ABSTRACT

A cold cathode fluorescent discharge tube is provided having, as an anode standing for one of discharge electrodes, a mercury discharge structure comprising a metal sintered body formed by sintering powder of a high melting point metal such as titanium, with mercury combined with the metal sintered body. The mercury discharge structure is so formed as to contain large amount of mercury and is therefore permitted to have a compact shape in order to obtain a requisite amount of mercury. The cold cathode fluorescent discharge tube permits a sufficient amount of mercury to be sealingly incorporated in the interior of the tube without decreasing the ratio of the effective luminescent length to the total length, having suitability to diameter reduction, and can be produced at low cost.

31 Claims, 2 Drawing Sheets

COLD CATHODE FLUORESCENT DISCHARGE TUBE

This application is a continuation of application Ser. No. 07/881,794, filed May 12, 1992 (abandoned).

BACKGROUND OF THE INVENTION

1. Field of the Invention

The present invention relates to a cold cathode fluorescent discharge tube having a tube sealingly incorporating a mercury discharge structure which is heated to discharge mercury contained in the structure and more particularly to a cold cathode fluorescent discharge tube having an anode of the construction which is advantageous to reduction of tube diameter.

2. Description of the Related Art

The cold cathode fluorescent discharge tube having a tube sealingly incorporating a mercury discharge structure for discharge of mercury has hitherto been well known. For example, JP-A-50-106468 discloses a discharge tube with a mercury discharge structure comprising a metal base, a porous layer of Zr plus Zr alloy or Ti plus Ti alloy secured to the metal base, and mercury impregnated in the porous layer, the metal base and the porous layer being secured to each other through an alloy layer which is created at the interface and made of a constituent metal of the metal base and a constituent metal of the porous layer.

JP-A-61-91849 discloses a mercury charged fluorescent discharge tube of hermetic seal type comprising a glass tube having its inner surface coated with phosphor, a first electrode sealingly mounted to one end of the glass tube and including a first electrode member having the function of emission and getter and a metal cap jointed to the first electrode member, and a second electrode sealingly mounted to the other end of the glass tube and including a mercury alloy body serving as a mercury discharge structure and a metal cap joined with the mercury alloy body.

For example, as described in the specification of the last mentioned reference, a ribbon-shaped structure sold by SAES Inc. in Italy is well known as the mercury alloy body in the mercury charged fluorescent discharge tube and specifically, it is possible to use as the mercury alloy body a mercury vapor dischargeable getter device disclosed in JP-B-49-5659 and in which powder of a mercury vapor generative composition standing for an intermetallic compound of at least two kinds of metals selected from the group consisting of mercury, zirconium and titanium is pressed in or press fitted on an annular ring or a rigid support.

In each of the aforementioned examples, the mercury discharge structure is subjected to preparatory work such as bending and cutting in consideration of the diameter of a discharge tube used and an installation site of the structure within the tube, and thereafter it is disposed at the installation site and heated externally of the tube through a heating operation such as high frequency heating to discharge mercury contained in the structure to the interior of the tube.

As described above, the cold cathode fluorescent discharge tube having, within the tube, the mercury discharge structure for discharge of mercury is well known and practiced in various ways as a light source of liquid crystal backlighting apparatus and other lighting apparatus.

Incidentally, in various lighting apparatus inclusive of the aforementioned liquid crystal back-lighting apparatus, reduction of the whole size has been desired in recent years, and further reduction of tube diameter has also been demanded strongly in the cold cathode fluorescent discharge tube serving as the light source.

Structurally, however, the mercury discharge structure sealingly incorporated in the tube of the conventional cold cathode fluorescent discharge tube uses a holder of any type for holding the mercury dischargeable compound, giving the following disadvantages to the diameter reduction of the discharge tube.

More particularly, the production process of discharge tubes such as the cold cathode fluorescent discharge tube usually includes such a high temperature applying step as a sealing step, and the mercury discharge structure essentially has a disadvantage that it is affected by a high temperature applied during the high temperature applying step to unnecessarily discharge part of mercury impregnated in the structure.

Accordingly, during the preparatory work, the mercury discharge structure has to be worked for diameter reduction in consideration of the tube, diameter and its shape (size) necessary for obtaining a requisite amount of mercury has to be studied and determined by taking into account the unnecessary discharge amount of mercury, making the preparatory work operation very difficult and troublesome and consequently raising problems that the production cost of the mercury discharge structure is increased to raise the cost of the discharge tube.

On the other hand, as far as the diameter reduction of the discharge tube is presupposed, the shape of the mercury discharge structure in consideration of the stipulated amount of mercury and the aforementioned unnecessary discharge amount is determined as an elongated shape because no mercury is contained in the holder.

In other words, when the mercury discharge structure is reduced in diameter on the presupposition that the diameter of the discharge tube is reduced, the length of the structure must be increased to secure the stipulated amount of mercury, and as a result, the ratio of an effective luminescent length to the total length of the discharge tube is decreased disadvantageously. In addition, depending on the conditions of elongated length, a practically effective discharge tube will not be obtained.

SUMMARY OF THE INVENTION

An object of the invention is to provide an inexpensive cold cathode fluorescent discharge tube suitable for diameter reduction which can permit a sufficient amount of mercury to be sealingly incorporated in the tube without decreasing the ratio of the effective luminescent length to the total length of the discharge tube.

DESCRIPTION OF THE PREFERRED EMBODIMENTS

Figure 1:
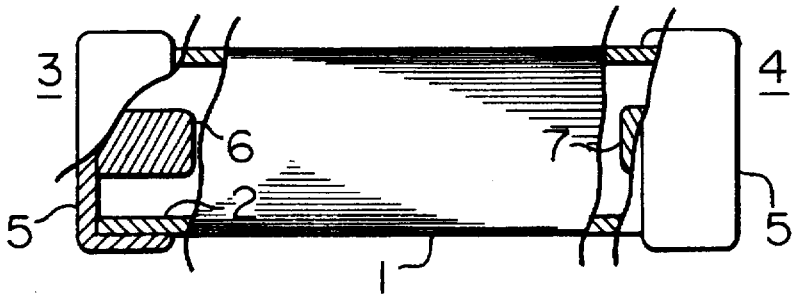
FIG. 1 is a front view, inclusive of a fragmentary section, showing an embodiment of a cold cathode fluorescent discharge tube according to the invention.

FIG. 1 is a front view, inclusive of fragmentary sections, showing an embodiment of a cold cathode fluorescent discharge tube according to the invention.

In the cold cathode fluorescent discharge tube of the invention, a glass tube 1 having its inner surface coated with phosphor 2 serves as an envelope and electrodes 3 and 4 for discharging are sealingly connected to opposite ends of the glass tube 1.

In the discharge electrode 3 serving as an anode, a mercury discharge structure 6 for discharging mercury to the interior of the glass tube 1 is connected to a metal cap 5 by, for example, welding, and in the other discharge electrode 4 serving as a cathode, a sintered body 7 prepared by sintering, for example, tungsten is connected to a second metal cap 5 by welding.

As will be detailed later with further reference to FIGS. 2A–2C, the mercury discharge structure 6 includes a metal sintered body 9 formed by sintering metal powder 8 of one kind or a plurality of kinds of metals such as titanium, zirconium, tantalum and nickel, and mercury 16 combined with the metal sintered body 9.

Thus, the whole of the mercury discharge structure 6 per se can retain mercury, so that mercury can be contained in the structure 6 at a far larger amount than in the conventional mercury discharge structure of the same volume provided with the holder. In other words, the requisite amount of mercury can be obtained with a compact-shape structure, and as a result, the cold cathode fluorescent discharge tube according to the embodiment of the invention shown in FIG. 1 can realize very easily the diameter reduction of the tube without decreasing the ratio of the effective luminescent length to the total length.

A method for production of the mercury discharge structure 6 will now be described briefly.

Figure 2A:
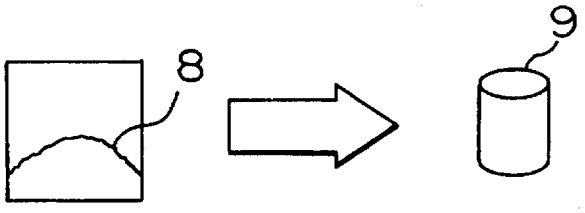
FIGS. 2A, 2B and 2C are schematic diagrams useful to explain an example of a method for production of a mercury discharge structure used for the cold cathode fluorescent discharge tube according to the invention, FIG. 2A illustrating a first step, FIG. 2B a second step and FIG. 2C a third step.
Figure 2B:
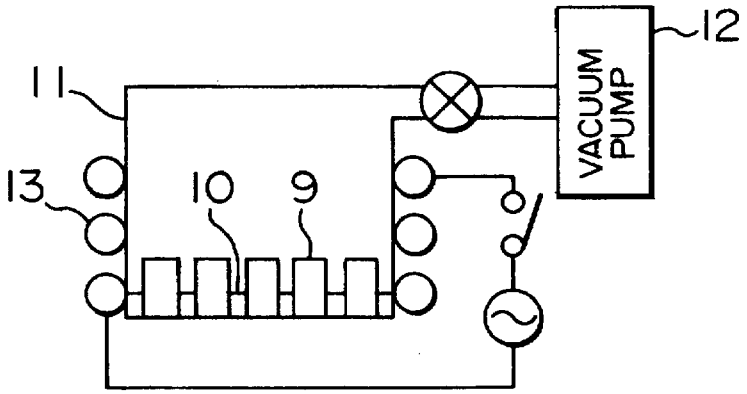
Figure 2C:
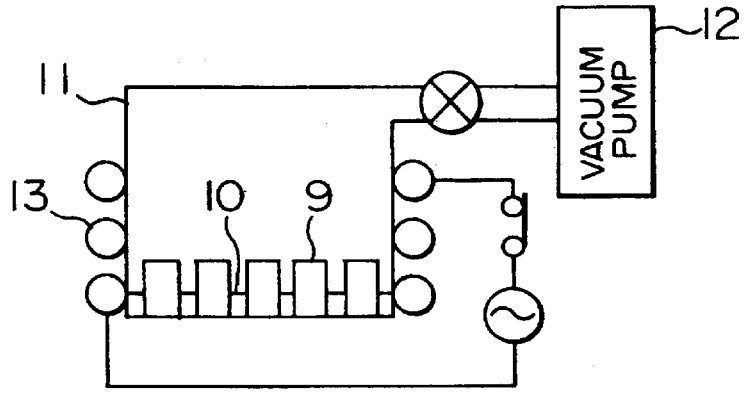

FIGS. 2A, 2B and 2C are schematic diagrams useful to explain an example of the method for production of the mercury discharge structure 6 used for the cold cathode fluorescent discharge tube according to the invention shown in FIG. 1.

Firstly, a first step is carried out as shown in FIG. 2A in which metal power 8 of one kind or a plurality of kinds of metals such as titanium, zirconium, tantalum and nickel is prepared and the metal powder 8 is sintered into a suitable shape, for example, a columnar shape in consideration of the tube diameter of a discharge tube used or a requisite amount of mercury to form a metal sintered body 9.

Subsequently, a second step is carried out as shown in FIG. 2B in which the metal sintered body 9 obtained through the first step is accommodated together with mercury 10 in a heating vessel 11 and the interior of the heating vessel 11 is evacuated to vacuum atmosphere by means of a vacuum pump 12.

After completion of the second step, a third step is carried out as shown in FIG. 2c in which the metal sintered body 9 and mercury 10 within the heating vessel 11 are heated at a temperature of from 800° to 900° C. for 3 to 4 hours by, for example, conducting electrical current through a high frequency coil 13 so as to be combined with each other.

Finally, after completion of the third step, a resulting structure is cooled and taken out of the heating vessel to provide a mercury discharge structure 6.

In the above example, the metal sintered body 9 and mercury 10 are sealingly incorporated directly in the heating vessel 11 which is usually made to be of a very large size. Therefore, in an alternative, the metal sintered body 9 and mercury 10 may be incorporated sealingly in a different enclosure defining vacuum atmosphere, and the third step for combining the metal sintered body 9 and mercury 10 may be carried out with the different enclosure placed within the heating vessel 11.

The mercury discharge structure 6 produced through the above production method is then welded to a metal cap 5 to form a discharge anode 3 in the embodiment shown in FIG. 1.

Since, as described previously, the mercury discharge structure 6 is formed by sintering powder of one kind or a plurality of kinds of high melting point metals such as titanium, zirconium, tantalum and nickel, it can be used as the discharge electrode 3 standing for the anode with no problem caused by such use.

By adopting, as the metal powder 8, metal powder of a mixture of titanium metal powder and non-volatile getter metal powder such as zirconium, tantalum, nickel or barium, a mercury discharge structure 6 having the so-called getter effect of absorbing impurity gases can be obtained.

The production of the cold cathode fluorescent discharge tube per se of the embodiment according to the invention shown in FIG. 1 can obviously be done through various production methods including, for example, one disclosed in the aforementioned JP-A-61-91849 and will not be detailed herein.

Figure 3A:
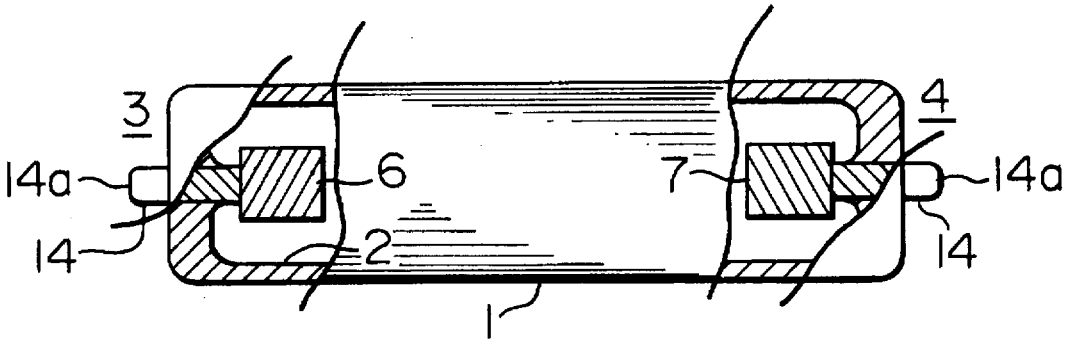
FIGS. 3A and 3B are front views, inclusive of fragmentary sections, showing cold cathode fluorescent discharge tubes according to further embodiments of the invention, respectively.
Figure 3B:
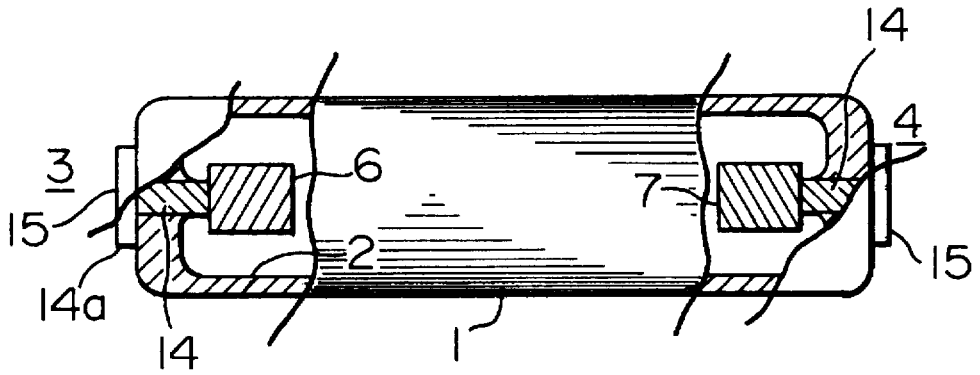

FIGS. 3A and 3B are front views, inclusive of fragmentary sections, showing further embodiments of the cold cathode fluorescent discharge tube according to the invention.

In the embodiment shown in FIG. 1, the mercury discharge structure 6 is welded directly to the metal cap 5 to form part of the discharge electrode 3, and the sintered body 7 is welded directly to a second metal cap 5 to form part of the discharge electrode 4. But in the embodiment shown in FIG. 3A, a mercury discharge structure 6 is welded to the other end of a metal rod 14 having one end 14*a* extending externally of a glass tube 1 to form a combined body which is used as a discharge electrode 3, and a sintered body 7 is welded to the other end of a second metal rod 14 having one end 14a extending externally of the glass tube 1 to form a combined body which is used as a discharge electrode 4.

In an alternative, the combined body of the mercury discharge structure 6 and metal rod 14 may be welded in turn to a metal cap 5 to form a discharge electrode 3, though not illustrated in the figure.

In the embodiment shown in FIG. 3B, one end 14*a* of the metal rod 14 extending externally of the glass tube 1 in the embodiment shown in FIG. 3A is welded to a metal flat plate 15, so that a mercury discharge structure 6, a metal rod 14 and a metal flat plate 15 are put together to form a combined body which is used as a discharge electrode 3, and a sintered body 7, a second metal rod 14 and a second metal flat plate 15 are put together to form a combined body which is used as a discharge electrode 4.

Figure 4A:
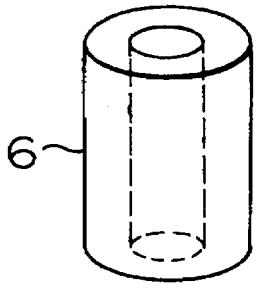
FIGS. 4A and 4B are perspective views showing further embodiments of the mercury discharge structure used for the cold cathode fluorescent discharge tube according to the invention.
Figure 4B:
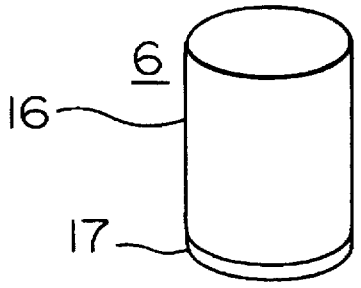

FIGS. 4A and 4B are perspective views showing further embodiments of the mercury discharge structure 6 used for the cold cathode fluorescent discharge tube according to the invention.

In the embodiment shown in FIG. 4A the columnar shape as a whole explained in connection with the embodiment of FIGS. 2A and 2B is modified to a cylindrical shape, whereby for example, when the cylindrical structure is welded to a metal cap 5 as in the embodiment of FIG. 1, the mercury discharge area can be increased, and besides, when the cylindrical structure has the getter effect, the area expected to contribute to the getter effect can be increased.

In the embodiment shown in FIG. 4B, for production of a metal sintered body 9, powder of a metal which will not be combined with mercury, for example, iron is prepared in addition to powder of a metal such as titanium described previously, and the two kinds of powder of metals, combinable and not combinable with mercury, are sintered in such a way that one thin end of a mercury discharge structure 6 is formed of the powder of metal not combinable with mercury.

More specifically, the structure 6 according to the embodiment shown in FIG. 4B is comprised of a preform 16 formed by sintering the powder of metal combinable with mercury and which contains mercury and a portion 17 formed by sintering the powder of metal not combinable with mercury and which does not contain mercury, whereby for example, when the structure is welded to a metal cap 5 as in the embodiment of FIG. 1, welding can be done at the portion 17 not containing mercury and so safety of welding operation can be promoted.

As described above, in the cold cathode fluorescent discharge tube according to the invention, the mercury discharge structure used as the anode standing for the discharge electrode and formed of the metal sintered body combined with mercury can dispense with the holder to attain an advantage of reduced volume, and for the same volume, it can contain a larger amount of mercury than the conventional structure provided with the holder. Consequently, even with a structure 6 of compact shape, the requisite amount of mercury can be obtained, and hence a sufficient amount of mercury can be discharged to the interior of the tube without decreasing the ratio of the effective luminescent length to the total length, thus advantageously realizing the diameter reduction of the tube very easily.

Further, in the cold cathode fluorescent discharge tube according to the invention, the amount of mercury to be contained in the mercury discharge structure used as the discharge electrode can be controlled by controlling the shape of the metal sintered body per se. Therefore, by controlling in advance the shape of the metal sintered body to a proper one in consideration of the conditions of use, the preparatory work such as bending and cutting can advantageously be avoided to save the cost, and the amount of mercury permitted to be discharged to the interior of the discharge tube during the production can advantageously be managed easily.

We claim:

1. A cold cathode fluorescent discharge tube having a cathode and an anode, said anode comprising a mercury discharge structure for discharging mercury within said discharge tube, said mercury discharge structure comprising a mercury alloy obtained by combining a metal sintered body with mercury;

said metal sintered body being formed by sintering powder consisting essentially of one kind or a plurality of kinds of metals combinable with said mercury into a desired shape which is predetermined according to a state of use of said anode, which results in a determination of a shape of said anode, said one kind or plurality of kinds of metals being selected from the group consisting of titanium and zirconium; and said mercury being combined with said metal sintered body which is sintered into said desired shape so as to provide said mercury alloy;

said mercury alloy being formed to have said desired shape of said metal sintered body when said metal sintered body and said mercury are combined with each other, and said mercury alloy thus formed being sealed within said discharge tube and used as said mercury discharge structure.

2. A cold cathode fluorescent discharge tube according to claim 1 wherein said desired shape is a column.

3. A cold cathode fluorescent discharge tube according to claim 1 wherein said desired shape is a cylindrical shape.

4. A cold cathode fluorescent discharge tube having a cathode and an anode, said anode comprising a mercury discharge structure for discharging mercury within said discharge tube, said mercury discharge structure including a mercury alloy comprising:

a metal sintered body formed by sintering a mixture of a first metal powder consisting of titanium powder and a second metal powder consisting of a non-volatile getter material powder selected from a group consisting of zirconium, tantalum, nickel and barium into a desired shape which is predetermined according to a state of use of said anode, which results in a determination of a shape of said anode; and mercury combined with said titanium powder of said metal sintered body which is sintered into said desired shape so as to provide said mercury alloy;

said mercury discharge structure, including said mercury alloy obtained by combining said titanium powder with said mercury, being formed to have said desired shape of said metal sintered body and thereafter being sealed within said discharge tube and used as said anode.

5. A cold cathode fluorescent discharge tube according to claim 4 wherein said second metal powder is powder of one kind or a plurality of kinds of metals taken from a group consisting of zirconium, tantalum and nickel.

6. A cold cathode fluorescent discharge tube according to claim 5 wherein said desired shape is a column.

7. A cold cathode fluorescent discharge tube according to claim 5 wherein said desired shape is a cylindrical shape.

8. A cold cathode fluorescent discharge tube according to claim 4 wherein said desired shape is a column.

9. A cold cathode fluorescent discharge tube according to claim 4 wherein said desired shape is a cylindrical shape.

10. A cold cathode fluorescent discharge tube having a cathode and an anode, said anode comprising a mercury discharge structure for discharging mercury within said discharge tube, said mercury discharge structure including a mercury alloy comprising:

a metal sintered body including a first portion formed by sintering a mixture consisting essentially of (i) a first metal powder of one kind or a plurality of kinds of metals combinable with mercury and (ii) a second portion formed by sintering a second metal powder of iron, said one kind or plurality of kinds of metals being selected from a group consisting of titanium and zirconium;

said metal sintered body being sintered to have a desired shape which is predetermined according to a state of use of said anode, which results in a determination of a shape of said anode, and said second portion forming a thin end portion of said desired shape; and mercury combined with said first portion which is sintered into said desired shape so as to form said mercury alloy;

said mercury discharge structure, including said mercury alloy obtained by combining said first portion and said mercury, being formed to have said desired shape of said metal sintered body and thereafter sealed within said discharge tube and used as a part of said anode.

11. A cold cathode fluorescent discharge tube according to claim 10 wherein said metal sintered body is welded through said second portion to a different member forming the anode.

12. A cold cathode fluorescent discharge tube according to claims wherein said desired shape is a column.

13. A cold cathode fluorescent discharge tube according to claim 11 wherein said desired shape is a cylindrical shape.

14. A cold cathode fluorescent discharge tube according to claim 10 wherein said desired shape is a column.

15. A cold cathode fluorescent discharge tube according to claim 10 wherein said desired shape is a cylindrical shape.

16. A cold cathode fluorescent discharge tube comprising:

a glass tube having on an inner surface a phosphor film;

an anode and a cold cathode sealingly mounted to opposite ends of said glass tube, said anode having a metal powder sintered body obtained by sintering a metal powder, said metal powder consisting essentially of a metal combinable with mercury to form a mercury alloy, said metal combinable with mercury being selected from a group consisting of titanium and zirconium, said metal powder being shaped into a desired shape which is predetermined according to a state of use of said anode, which results in a determination of a shape of said anode; and mercury combined with said metal powder sintered body to form said mercury alloy so as to be contained in said metal powder sintered body and sealingly incorporated in an interior of said glass tube, said mercury alloy, obtained by combining said metal powder sintered body with said mercury, being formed to have said desired shape of said metal powder sintered body and thereafter being disposed within said discharge tube and used as a part of said anode to discharge said mercury within said discharge tube.

17. A cold cathode fluorescent discharge tube according to claim 16 wherein said desired shape is a column which is concentrical with said glass tube.

18. A cold cathode fluorescent discharge tube according to claim 16 wherein said desired shape is a cylindrical shape.

19. A mercury discharge structure for discharging mercury, said mercury discharge structure comprising:

a metal sintered body having a first portion which is formed by sintering powder consisting essentially of one kind of metal or a plurality of kinds of metals selected from a group consisting of titanium and zirconium into a desired shape which is predetermined according to a state of final use of said mercury discharge structure, which results in a determination of a shape of said mercury discharge structure; and mercury combined with said one kind of metal or said plurality of kind of metals contained in said first portion of said metal sintered body which is sintered into the desired shape so as to form said mercury alloy;

said mercury discharge structure including said mercury alloy, obtained by combining said at least one metal contained in said metal sintered body with said mercury, being formed to have said desired shape of said metal sintered body.

20. A mercury discharge structure according to claim 19, wherein said metal sintered body is formed to have said desired shape by sintering metal powder which is obtained by combining:

said one kind of metal or said plurality of kinds of metals to form said first portion, and a second metal powder consisting of iron, said second metal powder forming a second portion which is joined with said first portion and which cannot contain the mercury, said second portion having one end of said desired shape which is thinner than said first portion.

21. A mercury discharge structure according to claim 19, wherein said metal sintered body is formed in a cylindrical shape.

22. A cold cathode fluorescent discharge tube having a mercury discharge structure built therein, comprising:

an envelope having an end to which said mercury discharge structure and a metal cap or metal rod are sealingly attached;

a metal sintered body formed by sintering metal powder consisting essentially of powder of a metal which can form a mercury alloy by combining with mercury, said metal which can form a mercury alloy being selected from a group consisting of titanium and zirconium, said metal sintered body being sintered into a desired shape which is predetermined according to a state of final use of said metal sintered body within said envelope, which results in a determination of a shape of said mercury discharge structure; and mercury combined with said powder of a metal which is contained in said metal sintered body which is sintered into the desired shape so as to form said mercury alloy;

said metal sintered body and said mercury being combined to form said mercury alloy to form said mercury discharge structure as a completed structure which has said desired shape of said metal sintered body, and said mercury discharge structure being provided to discharge said mercury within said envelope and maintained within said envelope by said metal cap or metal rod.

23. A cold cathode fluorescent discharge tube according to claim 22, wherein said metal sintered body is formed in a cylindrical shape.

24. A cold cathode fluorescent discharge tube comprising:

an envelope having on an inner surface a phosphor film;

a pair of discharge electrodes respectively having metal caps or metal rods sealingly connected to opposite ends of said envelope, at least one of said pair of discharge electrodes having a mercury discharge structure for discharging mercury within said envelope, said mercury discharge structure including:

a metal sintered body formed by sintering metal powder consisting essentially of powder of a metal which can form a mercury alloy by combining with mercury, said metal which can form a mercury alloy being selected from a group consisting of tantalum and zirconium, said metal sintered body being sintered into a desired shape which is predetermined according to a state of final use of said metal sintered body within said envelope, which results in a determination of a shape of said mercury discharge structure, and being secured to the metal cap or metal rod; and mercury combined with said powder of a metal contained in said metal sintered body which is sintered into the desired shape so as to form said mercury alloy, said mercury alloy, obtained by combining said powder of a metal with said mercury, forming said mercury discharge structure as a completed structure, said completed structure having said desired shape of said metal sintered body and being disposed within said envelope by one of said metal caps or metal rods.

25. A cold cathode fluorescent discharge tube according to claim 24, wherein said metal sintered body is formed in a cylindrical shape.

26. A mercury discharge body for discharging mercury, said mercury discharge body comprising:

a metal molded body formed by molding powder consisting essentially of one kind of metal or a plurality of kinds of metals into a desired shape which is predetermined according to a state of final use of said mercury discharge body, which results in a determination of a shape of said mercury discharge body, said one kind of metal or said plurality of kinds of metals being selected from a group consisting of titanium and zirconium; and mercury combined with said one kind of metal or said plurality of kinds of metals contained in said metal molded body which is formed in the desired shape so as to form said mercury alloy;

said mercury discharge body including said mercury alloy and having said desired shape of said metal molded body.

27. A cold cathode fluorescent discharge tube having a mercury discharge structure built therein for use as a discharge electrode, said discharge tube comprising:

an envelope having an end to which said mercury discharge structure and a metal cap or metal rod forming said discharge electrode are sealingly connected;

a metal molded body having a first portion which is formed by molding a first metal powder consisting essentially of powder of a metal which can form a mercury alloy by combining with mercury, said metal which can form a mercury alloy being selected from a group consisting of titanium and zirconium, said metal molded body being molded into a desired shape which is predetermined according to a state of final use of said metal molded body within said envelope, which results in a determination of a shape of said mercury discharge structure; and mercury combined with said first metal powder contained in said metal molded body which is molded into the desired shape so as to form said mercury alloy;

said metal molded body and said mercury being combined to form said mercury alloy to form said mercury discharge structure as a completed structure which has said desired shape of said metal molded body, said mercury discharge structure being held within said envelope by said metal cap or metal rod and used to discharge said mercury within said envelope.

28. A cold cathode fluorescent discharge tube according to claim 27, wherein said metal sintered body is formed by sintering into said desired shape metal powder obtained by combining:

said first metal powder to form said first portion, and a second metal powder consisting of iron, said second metal powder forming a second portion which is joined with said first portion and which cannot contain the mercury, said second portion forming one end of said desired shape which is thinner than a remainder of said desired shape.

29. A cold cathode fluorescent discharge tube having a cathode and an anode, said anode comprising a mercury discharge structure for discharging mercury within said discharge tube, said mercury discharge structure comprising a mercury alloy obtained by combining a metal sintered body with mercury;

said metal sintered body being formed by sintering a mixture of a first powder consisting essentially of a first kind or a plurality of kinds of metals combinable with said mercury, and a second powder consisting essentially of a second kind or plurality of kinds of metals, into a desired shape which is predetermined according to a state of use of said anode, which results in a determination of a shape of said anode, said first one kind or plurality of kinds of metals being selected from the group consisting of titanium and zirconium, said second one kind or plurality of kinds of metals being selected from the group consisting of zirconium, tantalum and nickel; and said mercury being combined with said metal sintered body which is sintered into said desired shape so as to provide said mercury alloy;

said mercury alloy being formed to have said desired shape of said metal sintered body when said metal sintered body and said mercury are combined with each other, and said mercury alloy thus formed being sealed within said discharge tube and used as said mercury discharge structure.

30. A mercury discharge structure for discharging mercury, said mercury discharge structure comprising:

a metal sintered body having a portion which is formed by sintering powder into a desired shape which is predetermined according to a state of final use of said mercury discharge structure, which results in a determination of a shape of said mercury discharge structure;

said sintering powder consisting essentially of a first metal powder consisting essentially of at least one metal, selected from the group consisting of titanium and zirconium, which can form a mercury alloy by combining with mercury, and, optionally, a second metal powder of a non-volatile getter material, consisting essentially of at least one metal selected from the group consisting of one or more of tantalum, nickel, and barium; and mercury combined with said metal contained in said portion of said metal sintered body which is sintered into the desired shape so as to form said mercury alloy;

said mercury discharge structure including said mercury alloy being formed to have said desired shape of said metal sintered body.

31. A cold cathode fluorescent discharge tube having a mercury discharge structure built therein, comprising:

an envelope having an end to which said mercury discharge structure and a metal cap or metal rod are sealingly attached;

a metal sintered body formed by sintering metal powder which is obtained by mixing first metal powder of a metal which can form an alloy by combining with mercury with a second metal powder of a non-volatile getter material;

said first metal powder consisting essentially of at least one metal selected from the group consisting of titanium and zirconium, and said second metal powder consisting essentially of one or more metals selected from the group consisting of tantalum, nickel and barium;

said metal sintered body being sintered into a desired shape, which is predetermined according to a state of final use of said metal sintered body within said envelope, which results in a determination of a shape of said mercury discharge structure; and mercury combined with said first metal powder of said at least one metal which is contained in said metal sintered body which is sintered into the desired shape to form said mercury alloy;

said metal sintered body and said mercury being combined to form said mercury alloy to form said mercury discharge structure as a completed structure which has said desired shape of said metal sintered body, and said mercury discharge structure being provided to discharge said mercury within said envelope and maintained within said envelope by said metal cap or metal rod.

* * * * *